US011214066B2

(12) United States Patent
Honda

(10) Patent No.: US 11,214,066 B2
(45) Date of Patent: Jan. 4, 2022

(54) RECORDING DEVICE AND RECORDING HEAD ERROR DETERMINING METHOD

(71) Applicant: SEIKO EPSON CORPORATION, Tokyo (JP)

(72) Inventor: Kenichi Honda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/824,747

(22) Filed: Mar. 20, 2020

(65) Prior Publication Data

US 2020/0298571 A1 Sep. 24, 2020

(30) Foreign Application Priority Data

Mar. 22, 2019 (JP) ..... JP2019-055350

(51) Int. Cl.
*B41J 2/145* (2006.01)
*B41J 2/165* (2006.01)

(52) U.S. Cl.
CPC ..... *B41J 2/165* (2013.01); *B41J 2/145* (2013.01); *B41J 2002/16582* (2013.01)

(58) Field of Classification Search
CPC ... B41J 2/145; B41J 2/165; B41J 2002/16582
See application file for complete search history.

(56) References Cited

U.S. PATENT DOCUMENTS 5,581,284 A * 12/1996 Hermanson ..... B41J 2/04505 347/40

FOREIGN PATENT DOCUMENTS

JP 2005-035102 A 2/2005

* cited by examiner

*Primary Examiner* — Lamson D Nguyen
(74) *Attorney, Agent, or Firm* — Global IP Counselors, LLP

(57) ABSTRACT

A recording device includes a recording head including a plurality of nozzle rows of a plurality of nozzles for ejecting a same color ink, a detector configured to detect, from among the plurality of nozzles, a defective nozzle having an ejecting defect, and a control unit configured to determine whether the recording head is in an error state, based on a detection result from the detector. The control unit determines that the recording head is in the error state when, among the plurality of nozzles having a specific positional relationship in which the nozzles are configured to compensate for each other's ejection, at least a predetermined number the nozzles, which is greater than one, is the defective nozzle.

4 Claims, 5 Drawing Sheets

RECORDING DEVICE AND RECORDING HEAD ERROR DETERMINING METHOD

The present application is based on, and claims priority from JP Application Serial Number 2019-055350, filed Mar. 22, 2019, the disclosure of which is hereby incorporated by reference herein in its entirety.

BACKGROUND

1. Technical Field

The present disclosure relates to a recording device and a recording head error determining method.

2. Related Art

An inkjet printer includes a recording head provided with a large number of nozzles, and the nozzle sometimes becomes clogged due to an increase in ink viscosity, inclusion of air bubbles, or the like. When the nozzle becomes clogged, even when the printer performs ejection of ink from the nozzle in terms of control, the printer may not actually eject the ink, or may not eject a required amount of the ink. As a result, a location occurs at which there is a recording failure of the dot in a recording result on a recording medium, namely, "dot omission" occurs. Since dot omission is problematic in terms of obtaining good recording quality, an inspection for dot omission is required.

As related art, a liquid ejecting device is disclosed that includes a test pattern forming unit in which a test pattern is formed by liquid ejected from a plurality of ejecting nozzles of a liquid ejecting head (see JP-A-2005-35102).

When dot omission is detected from the recording result of the test pattern, a printer determines that it is not appropriate to continue the recording. However, when the printer includes a plurality of nozzle rows capable of ejecting the same color ink, it may be possible to continue the recording even when some of the nozzles are clogged. In other words, with the printer of the related art, there is a possibility that, based on the recording result of the test pattern, the printer determines that it is not appropriate to continue the recording, even when the recording can be performed in actuality.

SUMMARY

A recording device includes a recording head including a plurality of nozzle rows of a plurality of nozzles for ejecting a same color ink, a detector configured to detect, from among the plurality of nozzles, a defective nozzle having an ejecting defect, and a control unit configured to determine whether the recording head is in an error state based on a detection result from the detector. The control unit determines that the recording head is in the error state when, among the plurality of nozzles that have a specific positional relationship in which the nozzles are configured to compensate for each other's ejection, at least a predetermined number of the nozzles, which is greater than one, is the defective nozzle.

DESCRIPTION OF EXEMPLARY EMBODIMENTS

An embodiment of the present disclosure will be described below with reference to the accompanying drawings. Each of the drawings is merely illustrative for describing the embodiment. Since each of the drawings is illustrative, the drawings may be inconsistent with each other, or parts thereof may be omitted.

1. Outline Description of Device

Figure 1:
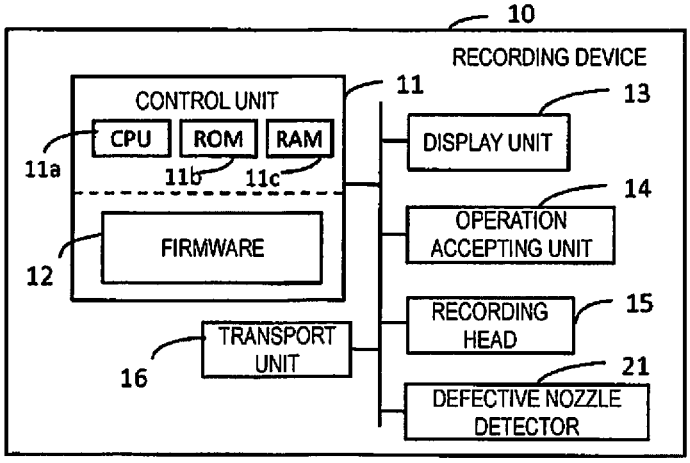
FIG. 1 is a block diagram illustrating a device configuration in a simplified manner.

FIG. 1 illustrates a configuration of a recording device 10 according to this embodiment in a simplified manner. The recording device 10 may be described as a liquid ejecting device, a printing apparatus, a printer, or the like. The recording device 10 performs an error determining method according to this embodiment. The recording device 10 is provided with a control unit 11, a display unit 13, an operation accepting unit 14, a recording head 15, a transport unit 16, a defective nozzle detector 21, and the like. The control unit 11 is configured to include one or a plurality of ICs including a CPU 11*a* as a processor, a ROM 11*b*, a RAM 11*c*, and the like, as well as a non-volatile memory, and the like.

The control unit 11 controls the recording device 10 using the processor, namely, by the CPU 11*a* performing arithmetic processing according to a program stored in the ROM 11*b*, the memory, and the like, using the RAM 11*c* or the like as a work area. For example, the control unit 11 performs the processing in accordance with a firmware 12, which is a type of the program. Note that the processor is not limited to a single CPU, and may be configured to perform the processing using a plurality of CPUs or a hardware circuit such as an Application Specific Integrated Circuit (ASIC), or may be configured to perform the processing by the CPU cooperating with the hardware circuit.

The display unit 13 is a unit for displaying visual information, and is configured by a liquid crystal display, an organic EL display, or the like, for example. The display unit 13 may be configured to include a display and a drive circuit for driving the display. The operation accepting unit 14 is a unit for accepting an operation by a user, and is realized, for example, by a physical button, a touch panel, a keyboard, or the like. Of course, the touch panel may be realized as a function of the display unit 13. The display unit 13 and the operation accepting unit 14 can be collectively referred to as an operating panel of the recording device 10.

The transport unit 16 is a mechanism for transporting a recording medium. As is known, the transport unit 16 includes a roller for transporting the recording medium from upstream to downstream of a transport path, a motor for rotating the roller, and the like. The recording medium is typically a sheet, but may be a medium other than the sheet as long as it is a medium on which recording is possible as a result of liquid being ejected thereon.

Figure 2:
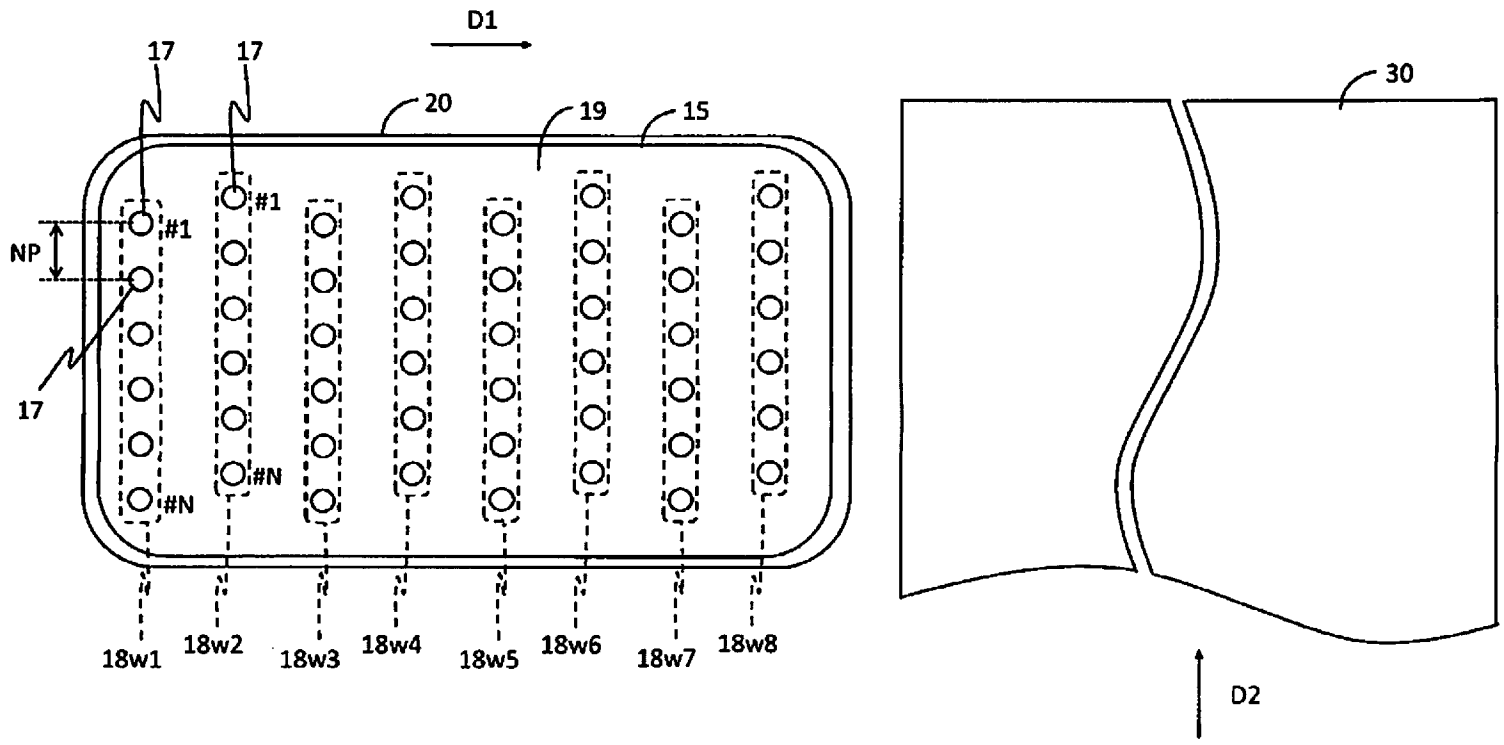
FIG. 2 is a diagram illustrating a nozzle arrangement of Example 1.
Figure 4:
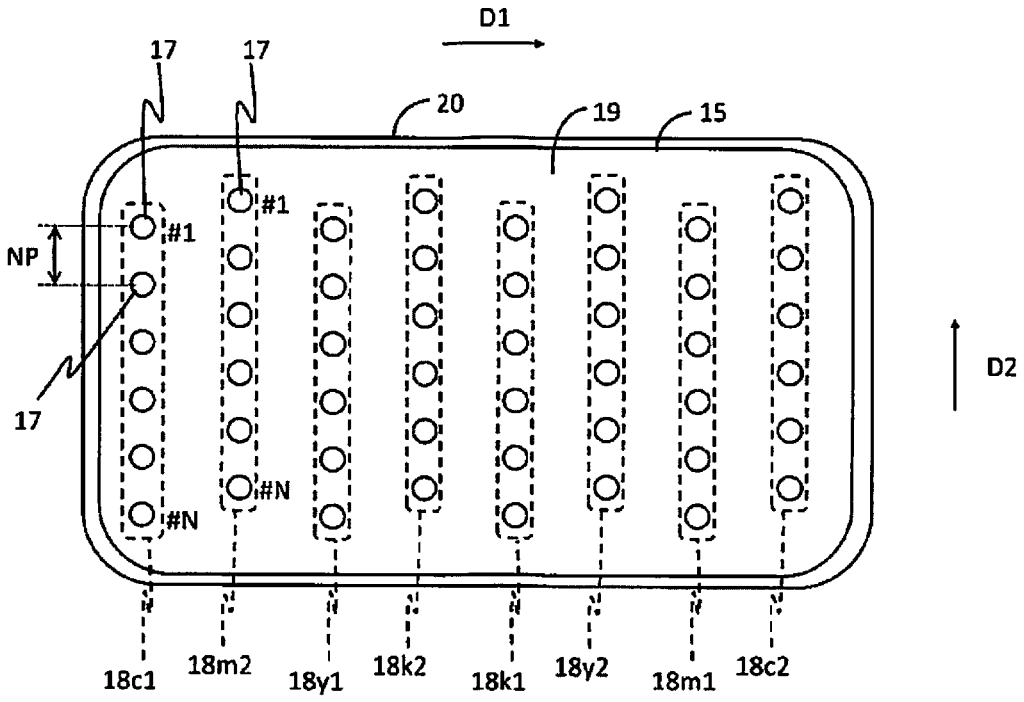
FIG. 4 is a diagram illustrating a nozzle arrangement of Example 2.

The recording head 15 ejects ink using an inkjet method to perform the recording. As illustrated in FIG. 2 and FIG. 4, the recording head 15 is provided with a plurality of nozzles 17 capable of ejecting the ink, and ejects the ink from the nozzles 17 onto a recording medium 30 transported by the transport unit 16. Ink droplets ejected by the nozzle 17 are also referred to as dots. The control unit 11 controls application of a drive signal to a drive element (not illustrated) provided in the nozzle 17 to cause the nozzle 17 to eject or not to eject the dots.

The defective nozzle detector 21 is a unit capable of performing processing for detecting a defective nozzle having an ejecting defect among the nozzles 17 included in the recording head 15. As described above, the "defective nozzle" refers to the nozzle 17 having the ejecting defect due to clogging or the like, even when, in terms of control, the ejection of the ink has been performed as a result of the drive signal being applied to the drive element provided in the nozzle 17. The ejecting defect includes not only a condition in which the dot cannot be ejected at all, but also a case in which the amount of liquid to be ejected is too small, and the like. The defective nozzle may also be referred to as an abnormal nozzle, or the like. The nozzle 17 that is not the defective nozzle is also referred to as a normal nozzle.

2. Nozzle Arrangement

FIG. 2 illustrates an arrangement example of the plurality of nozzles 17 included in the recording head 15. A description assuming the nozzle arrangement in the recording head 15 illustrated in FIG. 2 is also referred to as Example 1. Further, FIG. 2 illustrates a relationship between the recording head 15 and the recording medium 30 in a simplified manner.

The recording head 15 may be described as a liquid ejecting head, a printing head, a print head, or the like. In the example of FIG. 2, the recording head 15 is mounted on a carriage 20 capable of reciprocating in parallel to a predetermined first direction D1, and moves with the carriage 20. In other words, although omitted in FIG. 1, according to the example of FIG. 2, the recording device 10 includes the carriage 20, and the control unit 11 also controls the movement of the carriage 20.

The first direction D1 is also referred to as a main scanning direction. The transport unit 16 transports the recording medium 30 in a second direction D2 intersecting the first direction D1. The second direction D2 is also referred to as a sub scanning direction or a transport direction. "Intersecting" used here means being orthogonal. Note that, in this embodiment, expressions such as parallel, orthogonal, constant, same, and the like with respect to directions, distances, and positions may mean not only strictly parallel, orthogonal, constant, same, and the like, but may also include differences to an extent that occur as a result of accuracy in the manufacturing or assembly of parts.

Reference sign 19 denotes a nozzle surface 19 in which the nozzles 17 of the recording head 15 are open. FIG. 2 illustrates an arrangement of the plurality of nozzles 17 in the nozzle surface 19. In a configuration in which ink is supplied from an ink holding unit (not illustrated), which is referred to as an ink cartridge, an ink tank, or the like that is mounted in the recording device 10, and the ink is ejected from the nozzles 17, the recording head 15 is provided with nozzle rows each corresponding to a predetermined ink color. The single nozzle row is configured by the plurality of nozzles 17 that have a constant nozzle pitch NP, which is an interval between the nozzles 17 along the second direction D2, and that eject the same color ink. The recording head 15 ejects color inks such as cyan (C), magenta (M), yellow (Y), black (K), white (W), and the like, for example.

In Example 1, the recording head 15 is provided with nozzle rows 18*w*1, 18*w*2, 18*w*3, 18*w*4, 18*w*5, 18*w*6, 18*w*7, and 18*w*8 that are configured by the plurality of nozzles 17 for ejecting ink W. In other words, all the eight nozzle rows 18*w*1, 18*w*2, 18*w*3, 18*w*4, 18*w*5, 18*w*6, 18*w*7, and 18*w*8 are the nozzle rows for ejecting the ink W. In the recording head 15, a plurality of the nozzle rows are arranged side by side along the first direction D1. In a region, which is positioned downstream of the recording head 15 in the transport direction and in which the recording using the ink W has been performed by the recording head 15 of Example 1, color ink is ejected from the recording head including the nozzles capable of ejecting the color ink, and thus, a color image is recorded.

In Example 1, the positions of the nozzles 17 in the second direction D2 are the same as each other in every other nozzle row, namely, the nozzle rows 18*w*1, 18*w*3, 18*w*5, and 18*w*7 included in the recording head 15. In addition, the positions of the nozzles 17 in the second direction D2 are the same as each other in the remaining every other nozzle row, namely, the nozzle rows 18*w*2, 18*w*4, 18*w*6, and 18*w*8. In Example 1, each of the nozzle rows 18*w*1, 18*w*3, 18*w*5, and 18*w*7 is referred to as a first nozzle row, and each of the nozzle rows 18*w*2, 18*w*4, 18*w*6, and 18*w*8 is referred to as a second nozzle row.

A group of the first nozzle rows, namely, the nozzle rows 18*w*1, 18*w*3, 18*w*5, and 18*w*7, is collectively referred to as a first nozzle row group. A group of the second nozzle rows, namely, the nozzle rows 18*w*2, 18*w*4, 18*w*6, and 18*w*8, is collectively referred to as a second nozzle row group. The first nozzle row group and the second nozzle row group are arranged so that the positions of the nozzles 17 in a nozzle row direction are offset with respect to each other by a distance equivalent to half of the nozzle pitch NP in the second direction D2. Thus, when the first nozzle rows and the second nozzle rows are combined together, the nozzles 17 are arranged at an interval equivalent to half of the nozzle pitch NP in the second direction D2. In the example of FIG. 2, the nozzle row direction and the second direction D2 are in parallel. The nozzle row direction is a direction in which the plurality of nozzles 17 configuring the nozzle row are arranged side by side.

Of course, the plurality of nozzle rows corresponding to the ejection of the same color ink in the recording head 15 may be greater or less than eight rows. Further, as long as the above-described characteristics of the first nozzle row group and the second nozzle row group are realized, the nozzle row direction may be inclined with respect to the second direction D2.

The recording device 10 can realize the recording onto the recording medium 30 by alternately repeating transport of the recording medium 30 by a predetermined transport amount using the transport unit 16, and ejection of the ink by the recording head 15 along with the movement of the carriage 20.

A configuration for performing the error determining method according to this embodiment may be realized by a single independent device, but may also be realized by an information processing device and a printer that are communicatively connected with each other. The information processing device is, for example, a personal computer, a smart phone, a tablet terminal, a mobile phone, a server, or a device having a similar degree of processing capability as those devices. In other words, the recording device 10 may be realized by the information processing device as a recording control device including the control unit 11, and the like, and the printer including the recording head 15, the carriage 20, the transport unit 16, the defective nozzle detector 21, and the like.

3. Error Determining Processing

Figure 3:
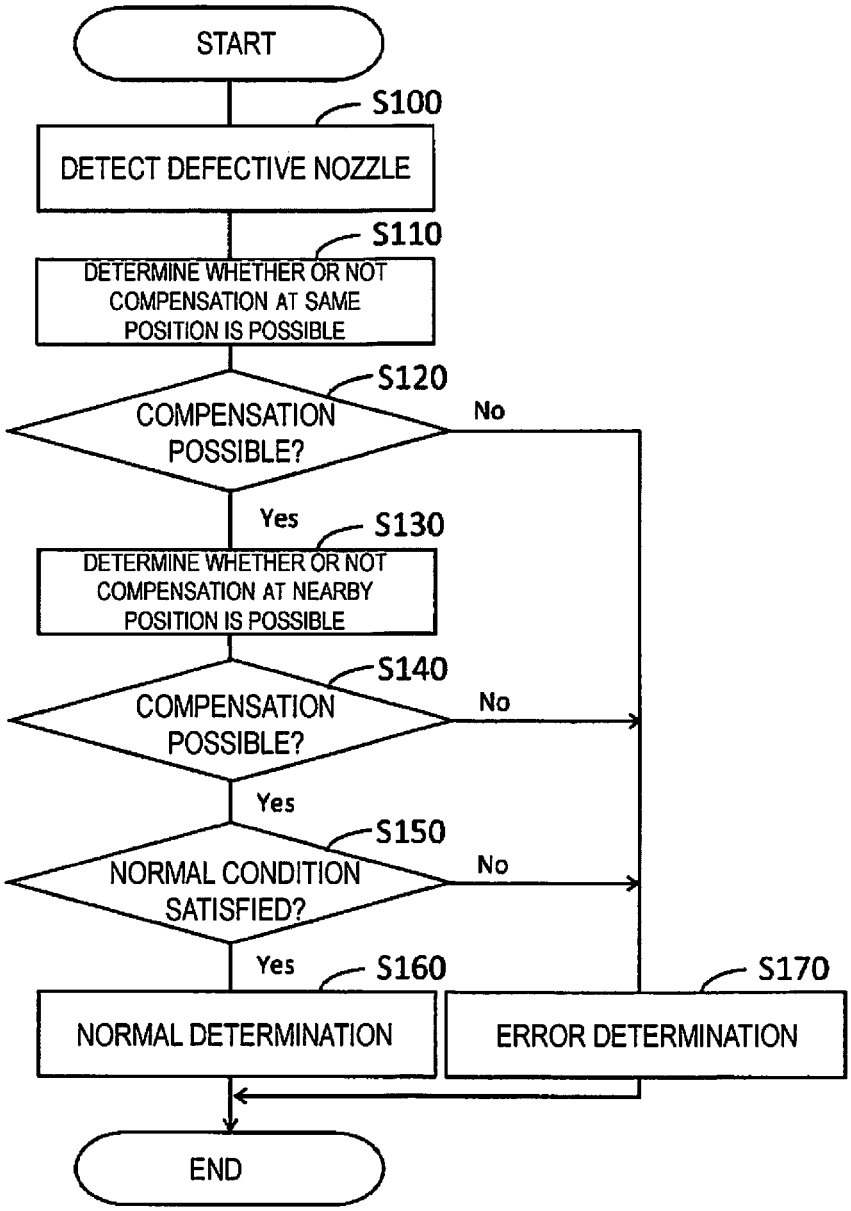
FIG. 3 is a flowchart illustrating error determining processing.

FIG. 3 illustrates, using a flowchart, error determining processing according to Example 1 performed by the control unit 11 in accordance with the firmware 12. The error determining processing is processing for determining whether or not the recording head 15 is in a normal state for performing the recording.

At step S100, the control unit 11 causes the defective nozzle detector 21 to perform defective nozzle detecting processing, and acquires a result of the defective nozzle detecting processing. Various types of defective nozzle detecting processing can be employed as long as it is possible to detect whether or not each of the nozzles 17 is the defective nozzle. For example, the defective nozzle detector 21 may detect the defective nozzle using a method disclosed in JP-A-2013-126776. Specifically, whether or not the ink is normally ejected from the nozzle 17 is detected by measuring a waveform of so-called residual vibration of a vibrating plate or the like, which bends in response to deformation of the drive element (a piezoelectric element) caused by the application of the drive signal. The vibration plate is a part of a structural element configuring the recording head 15, and is a portion that deforms to push out the ink from the nozzle 17.

Further, the defective nozzle detector 21 aligns relative positions of a light emitter and the recording head 15 so that a laser light emitted from the light emitter intersects an ink flying path of the nozzle 17 to be inspected, for example. Then, a laser method may be employed in which, when light shielding of the laser light by the dot ejected from the nozzle 17 cannot be detected by a light receiver, the nozzle being inspected is determined to be the defective nozzle. In this manner, the defective nozzle detector 21 drives each of the nozzles 17 to cause it to perform an ink ejecting operation. The ink may be ejected onto the recording medium 30 or onto a member such as a maintenance box provided in the recording device 10 for recovering the ejected ink.

By performing the defective nozzle detecting processing, the defective nozzle detector 21 generates defective nozzle information that describes whether each of the nozzles 17 included in the recording head 15 is the defective nozzle or the normal nozzle. The control unit 11 acquires such defective nozzle information. In other words, at step S100, the control unit 11 acquires the latest defective nozzle information. Note that in this embodiment, the recording device 10 does not perform the recording, onto the recording medium 30, of the test pattern for evaluating the presence or absence of the dot omission from the recording result.

Step S100 corresponds to a detecting step for detecting the defective nozzle having the ejecting defect among the nozzles 17 of the recording head 15.

Step S110 and subsequent steps correspond to a determining step for determining whether or not the recording head 15 is in an error state based on a detection result from the detecting step.

At step S110, the control unit 11 refers to the defective nozzle information and determines whether or not compensation by the nozzle 17 at the same position is possible. The "same position" at step S110 refers to the same position in the second direction D2. The plurality of nozzles 17 having the same position in the second direction D2 can be said to have a "specific positional relationship in which mutual ejection compensation is possible". Mutual ejection compensation means that even when the dot omission occurs in one of the nozzles due to the ejecting defect, the dot omission is made substantially visually unrecognizable by ejection of the ink from another of the nozzles. More specifically, the plurality of nozzles 17 that have the same position in the second direction D2 belong to the different nozzle rows, and have a positional relationship in which a common raster line can be recorded. The raster line is a line parallel to the first direction D1.

The nozzles 17 configuring the nozzle rows will be described while assigning a number to each of the nozzles 17. As a specific example, as illustrated in FIG. 2, for each of the nozzles 17 configuring the nozzle rows, an integer from #1 to #N is sequentially assigned as a nozzle number from downstream to upstream in the second direction D2. The nozzle numbers #1 to #N are assigned to the respective nozzles 17 in all of the nozzle rows. N is the number of nozzles configuring the single nozzle row, and in the example of FIG. 2, N=6. Of course, the number of nozzles configuring the nozzle row is not limited, and in an actual product, N is a number such as several hundred, for example.

The positions of the nozzles 17 of the nozzle rows 18*w*1, 18*w*3, 18*w*5, and 18*w*7 of the first nozzle row group are aligned with each other in the second direction D2. Therefore, in the first nozzle row group, the nozzles 17 having the matching nozzle numbers have the same positional relationship. Similarly, the positions of the nozzles 17 in the nozzle rows 18*w*2, 18*w*4, 18*w*6, and 18*w*8 of the second nozzle row group are aligned with each other in the second direction D2. Therefore, in the second nozzle row group, the nozzles 17 having the matching nozzle numbers have the same positional relationship. In other words, in Example 1, when the first nozzle group and the second nozzle group are combined together, 2×N positions can be ascertained as the positions of the nozzles 17 in the second direction D2.

The control unit 11 determines whether or not the number of defective nozzles is equal to or greater than a predetermined number for each of the above-described positions of the nozzles 17 in the second direction D2. In this embodiment, the "predetermined number" is an integer greater than one. Referring to FIG. 2, the number of nozzles 17 having the same position in the second direction D2 is four. For example, the total of four nozzles 17 having the nozzle number #1 in each of the nozzle rows 18*w*1, 18*w*3, 18*w*5, and 18*w*7 have the same position in the second direction D2. The control unit 11 refers to the defective nozzle information, and determines that the number of defective nozzles is equal to or greater than the predetermined number for this position, when three or more of the nozzles 17 are the defective nozzles among those four nozzles 17 having the same position. On the other hand, of the four nozzles 17 having the same position, when less than three of the nozzles 17 are the defective nozzles, it is determined that the number of defective nozzles is less than the predetermined number for this position. The control unit 11 performs such a determination for all of the positions of the nozzles 17 in the second direction D2. Then, when the number of defective nozzles is less than the predetermined number for all of the positions of the nozzles 17 in the second direction D2, the control unit 11 determines that compensation by the nozzle 17 having the same position is possible. On the other hand, when the number of defective nozzles is equal to or greater than the predetermined number in at least one of the positions of the nozzles 17 in the second direction D2, the control unit 11 determines that compensation by the nozzle 17 having the same position is not possible.

At step S120, the control unit 11 branches the processing in accordance with the determination result at step S110. In other words, when the control unit 11 determines that compensation by the nozzle 17 having the same position is possible, the processing proceeds to step S130 from a "Yes" determination at step S120. On the other hand, when it is determined that compensation by the nozzle 17 having the same position is not possible, the processing proceeds to step S170 from a "No" determination at step S120.

At step S130, the control unit 11 refers to the defective nozzle information, and determines whether or not compensation by the nozzle 17 having a nearby position is possible. The "nearby position" at step S130 refers to a positional relationship between the nozzle 17 belonging to the first nozzle row and the nozzle 17 belonging to the second nozzle row, and indicates a positional relationship of being adjacent in the nozzle row direction. For convenience, the nozzle 17 belonging to the first nozzle row is referred to as a first nozzle, and the nozzle 17 belonging to the second nozzle row is referred to as a second nozzle. The first nozzle and the second nozzle in the nearby position can substantially compensate for each other's recording as a result of the ejected dot seeping and spreading in the recording medium 30. Therefore, it can be said that the first nozzle and the second nozzle in the nearby position have the "specific positional relationship in which the mutual ejection compensation is possible". Hereinafter, the first nozzle and the second nozzle in the nearby position are referred to as a "nearby nozzle pair".

According to the example of FIG. 2, the first nozzle having a nozzle number #n and the second nozzle having the nozzle number #n correspond to one of the nearby nozzle pairs. n is an integer from 1 to N. Further, according to the example of FIG. 2, the first nozzle having the nozzle number #n and the second nozzle having a nozzle number #n+1 correspond to one of the nearby nozzle pairs. In the example of FIG. 2, there are four each of the first nozzle rows and the second nozzle rows, but here, the nearby nozzle pairs to be determined at step S130 are extracted only from pairs of the first nozzle rows and the second nozzle rows adjacent to each other. In other words, the control unit 11 extracts all the nearby nozzle pairs from among the nozzle row 18*w*1 and the nozzle row 18*w*2. Similarly, the control unit 11 extracts all the nearby nozzle pairs from among the nozzle row 18*w*3 and the nozzle row 18*w*4, extracts all the nearby nozzle pairs from among the nozzle row 18*w*5 and the nozzle row 18*w*6, and extracts all the nearby nozzle pairs from among the nozzle row 18*w*7 and the nozzle row 18*w*8.

The control unit 11 determines, for each of the nearby nozzle pairs extracted as described above, whether or not the two nozzles 17 configuring the nearby nozzle pair are both the defective nozzles. The control unit 11 refers to the defective nozzle information, and when both of the two nozzles 17 configuring the nearby nozzle pair are the defective nozzles, the control unit 11 determines that the number of defective nozzles is equal to or greater than a predetermined number for this nearby nozzle pair. On the other hand, when there is less than two of the defective nozzles among the two nozzles 17 configuring the nearby nozzle pair, it is determined that the number of defective nozzles is less than the predetermined number for this nearby nozzle pair. The control unit 11 makes such a determination for all of the extracted nearby nozzle pairs. Then, when the number of defective nozzles is less than the predetermined number for all of the extracted nearby nozzle pairs, the control unit 11 determines that compensation by the nozzle 17 in the nearby position is possible. On the other hand, when the number of defective nozzles is equal to or greater than the predetermined number for at least one of the extracted nearby nozzle pairs, the control unit 11 determines that compensation by the nozzle 17 in the nearby position is not possible.

The predetermined number used in the determination at step S110 may be referred to as a first predetermined number, and the predetermined number used in the determination at step S130 may be referred to as a second predetermined number, to make a distinction therebetween.

At step S140, the control unit 11 branches the processing in accordance with the determination result at step S130. In other words, when the control unit 11 determines that compensation by the nozzle 17 in the nearby position is possible, the processing proceeds to step S150 from a "Yes" determination at step S140. On the other hand, when it is determined that compensation by the nozzle 17 in the nearby position is not possible, the processing proceeds to step S170 from a "No" determination at step S140.

At step S150, the control unit 11 refers to the defective nozzle information, and determines whether or not the number of defective nozzles satisfies a predetermined normal condition. For example, the control unit 11 determines that the normal condition is not satisfied when the total number of defective nozzles is equal to or greater than a third predetermined number. Further, for example, the control unit 11 also determines that the normal condition is not satisfied when the number of defective nozzles in the nozzle row is equal to or greater than a fourth predetermined number. When the normal condition is satisfied, the processing proceeds to step S160 from a "Yes" determination at step S150. On the other hand, when the normal condition is not satisfied, the processing proceeds to step S170 from a "No" determination at step S150.

At step S160, the control unit 11 determines that the recording head 15 is in the normal state, and terminates the processing of the flowchart in FIG. 3. In other words, the control unit 11 determines that the recording head 15 is in the normal state based on a determination that the recording head 15 does not have the defective nozzles to an extent that would cause the recording quality to deteriorate.

On the other hand, at step S170, the control unit 11 determines that the recording head 15 is in the error state, and terminates the processing of the flowchart in FIG. 3. In other words, the control unit 11 determines that the recording head 15 is in the error state based on a determination that the recording head 15 has the defective nozzles to the extent that would cause the recording quality to deteriorate. When the processing proceeds to step S170, the control unit 11 may determine that the recording head 15 is in the error state, and may further perform processing or display for fixing the defective nozzle. The processing for fixing the defective nozzle is, for example, so-called flushing of the recording head 15. Further, the display for fixing the defective nozzle is a warning display prompting the user to clean the recording head 15 or to replace the recording head 15, for example. The control unit 11 causes the display unit 13 to output the warning display.

The order of steps S110 and S120 and steps S130 and S140 may be reversed. In other words, after step S100, the control unit 11 may perform steps S130 and S140, and when the "Yes" determination is made at step S140, the control unit 11 may perform steps S110 and S120.

Further, a configuration in which only either steps S110 and S120 or steps S130 and 140 are performed is also part of the disclosure according to this embodiment. In other words, after step S100, the control unit 11 may cause the processing to proceed to steps S150 and S160 or step S170 as a result of performing steps S110 and S120. Alternatively, after step S100, the control unit 11 may cause the processing to proceed to steps S150 and S160 or step S170 as a result of performing steps S130 and S140.

Further, step S150 may be omitted. In other words, when the control unit 11 determines "Yes" at step S120 or determines "Yes" at step S140, the control unit 11 may cause the processing to proceed to step S160 without performing step S150.

4. Example 2

FIG. 4 illustrates an arrangement example of the plurality of nozzles 17 included in the recording head 15. A description assuming the nozzle arrangement in the recording head 15 illustrated in FIG. 4 is also referred to as Example 2. Illustration of the recording medium 30 is omitted in FIG. 4. With respect to Example 2, a description of content that is common to Example 1 is omitted.

In Example 2, the recording head 15 includes nozzle rows 18*c*1 and 18*c*2 configured by the plurality of nozzles 17 for ejecting ink C, nozzle rows 18*m*1 and 18*m*2 configured by the plurality of nozzles 17 for ejecting ink M, nozzle rows 18*y*1 and 18*y*2 configured by the plurality of nozzles 17 for ejecting ink Y, and nozzle rows 18*k*1 and 18*k*2 configured by the plurality of nozzles 17 for ejecting ink K.

In Example 2, the positions of the nozzles 17 in the second direction D2 are the same as each other in every other nozzle row, namely, the nozzle rows 18*c*1, 18*y*1, 18*k*1, and 18*m*1 included in the recording head 15. In addition, the positions of the nozzles 17 in the second direction D2 are the same as each other in the remaining every other nozzle row, namely, the nozzle rows 18*m*2, 18*k*2, 18*y*2, and 18*c*2. Therefore, in Example 2, each of the nozzle rows 18*c*1, 18*y*1, 18*k*1, and 18*m*1 is the first nozzle row, and each of the nozzle rows 18*m*2, 18*k*2, 18*y*2, and 18*c*2 is the second nozzle row. In a relationship between the nozzle row 18*c*1 and the nozzle row 18*c*2 for ejecting the ink C, the nozzle row 18*c*1 is the first nozzle row, and the nozzle row 18*c*2 is the second nozzle row.

Similarly, in a relationship between the nozzle row 18*m*1 and the nozzle row 18*m*2 for ejecting the ink M, the nozzle row 18*m*1 is the first nozzle row, and the nozzle row 18*m*2 is the second nozzle row. In a relationship between the nozzle row 18*y*1 and the nozzle row 18*y*2 for ejecting the ink Y, the nozzle row 18*y*1 is the first nozzle row, and the nozzle row 18*y*2 is the second nozzle row. In a relationship between the nozzle row 18*k*1 and the nozzle row 18*k*2 for ejecting the ink K, the nozzle row 18*k*1 is the first nozzle row, and the nozzle row 18*k*2 is the second nozzle row.

In Example 2, a group of the first nozzle rows, namely, the nozzle rows 18*c*1, 18*y*1, 18*k*1, and 18*m*1, is collectively referred to as the first nozzle row group, and a group of the second nozzle rows, namely, the nozzle rows 18*m*2, 18*k*2, 18*y*2, and 18*c*2, is collectively referred to as the second nozzle row group. The first nozzle row group and the second nozzle row group are arranged so as to be offset from each other in the nozzle row direction by the distance equivalent to half the nozzle pitch NP in the second direction D2.

Figure 5:
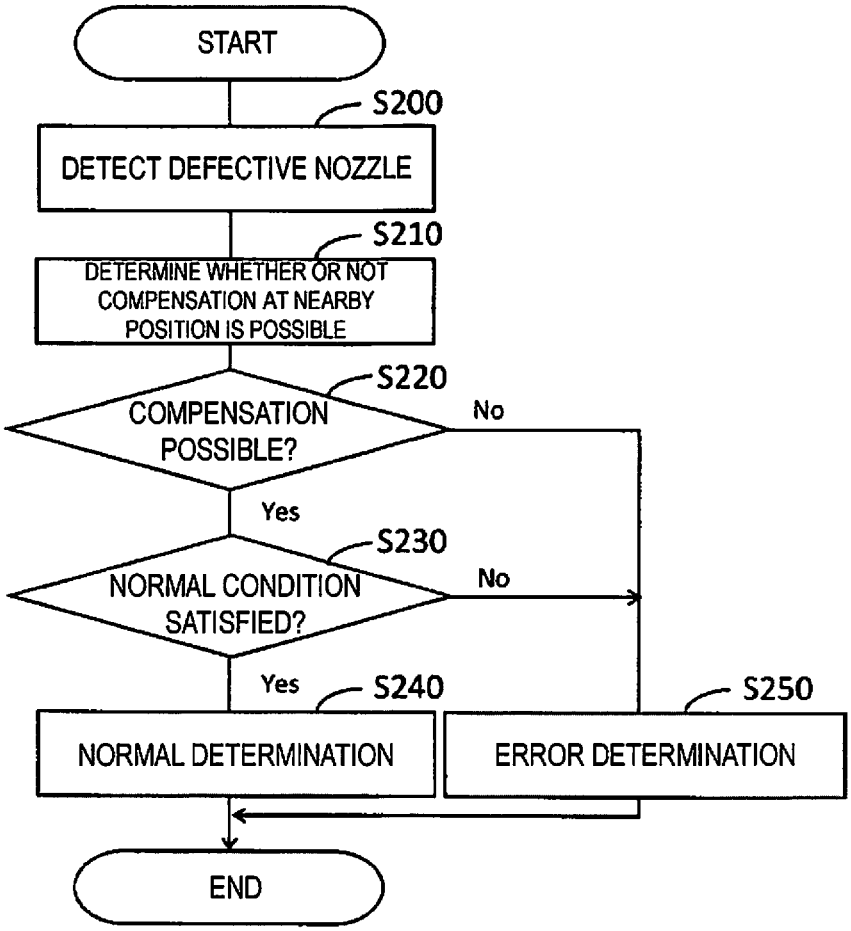
FIG. 5 is a flowchart illustrating error determining processing according to Example 2.

FIG. 5 illustrates, using a flowchart, error determining processing according to Example 2 performed by the control unit 11 in accordance with the firmware 12. Step S200 is the same as step S100 in Example 1. Step S210 and subsequent steps can be considered to be generally the same as step S130 and the subsequent steps in Example 1.

At step S210, the control unit 11 refers to the defective nozzle information, and determines whether or not compensation by the nozzle 17 in the nearby position is possible. The meaning of the nearby position is as already described above.

In Example 2, in the relationship between the nozzle row 18*c*1 and the nozzle row 18*c*2, the first nozzle having the nozzle number #n and the second nozzle having the nozzle number #n correspond to one of the nearby nozzle pairs, and the first nozzle having the nozzle number #n and the second nozzle having a nozzle number #n+1 correspond to one of the nearby nozzle pairs. Similarly, in the relationship between the nozzle row 18*y*1 and the nozzle row 18*y*2, the first nozzle having the nozzle number #n and the second nozzle having the nozzle number #n correspond to one of the nearby nozzle pairs, and the first nozzle having the nozzle number #n and the second nozzle having the nozzle number #n+1 correspond to one of the nearby nozzle pairs.

Similarly, in the relationship between the nozzle row 18*m*1 and the nozzle row 18*m*2, the first nozzle having the nozzle number #n and the second nozzle having the nozzle number #n correspond to one of the nearby nozzle pairs, and the first nozzle having the nozzle number #n and the second nozzle having the nozzle number #n+1 correspond to one of the nearby nozzle pairs. Similarly, in the relationship between the nozzle row 18*k*1 and the nozzle row 18*k*2, the first nozzle having the nozzle number #n and the second nozzle having the nozzle number #n correspond to one of the nearby nozzle pairs, and the first nozzle having the nozzle number #n and the second nozzle having the nozzle number #n+1 correspond to one of the nearby nozzle pairs.

The control unit 11 refers to the defective nozzle information, and when both of the two nozzles 17 configuring the nearby nozzle pair are the defective nozzles, the control unit 11 determines that the number of defective nozzles is equal to or greater than a predetermined number for this nearby nozzle pair. On the other hand, when there is less than two of the defective nozzles among the two nozzles 17 configuring the nearby nozzle pair, it is determined that the number of defective nozzles is less than the predetermined number for this nearby nozzle pair. The control unit 11 determines that compensation by the nozzle 17 in the nearby position is possible when the number of defective nozzles is less than the predetermined number for all of the nearby nozzle pairs, On the other hand, when the number of defective nozzles for at least one of the nearby nozzle pairs is equal to or greater than the predetermined number, the control unit 11 determines that compensation by the nozzle 17 in the nearby position is not possible.

At step S220, the control unit 11 branches the processing in accordance with the determination result at step S210. When the control unit 11 determines that compensation by the nozzle 17 in the nearby position is possible, the control unit 11 causes the processing to proceed to step S230 from a "Yes" determination at step S220. On the other hand, when it is determined that compensation by the nozzle 17 in the nearby position is not possible, the processing proceeds to step S250 from a "No" determination at step S220. Steps S230, S240, and S250 are the same as steps S150, S160, and S170 in Example 1. Step S230 may be omitted.

5. Summary

As described above, according to this embodiment, the recording device 10 includes the recording head 15 including the plurality of nozzle rows configured by the plurality of nozzles 17 for ejecting the same color ink, a detector (the defective nozzle detector 21) configured to detect the defective nozzle having the ejecting defect, among the plurality of nozzles 17, and the control unit 11 configured to determine whether the recording head 15 is in the error state, based on the detection result from the detector. The control unit 11 determines that the recording head 15 is in the error state when, of the plurality of nozzles 17 having the specific positional relationship in which the mutual ejection compensation is possible, a number of the nozzles 17 equal to or greater than the predetermined number, which is greater than one, are the defective nozzles.

According to this configuration, when, in the recording head 15, less than the predetermined number of the nozzles 17 are the defective nozzles, among the plurality of nozzles 17 having the specific positional relationship in which the mutual ejection compensation is possible, the control unit 11 does not determine that the recording head 15 is in the error state. In this way, it is possible to avoid a situation in which the recording device determines that the recording by the recording head is not possible, even when the recording is possible by compensating for the dot omission caused by the defective nozzle using the normal nozzle. As a result, operating efficiency of the user can be improved.

Further, according to this configuration, the control unit 11 makes the determination based on the detection result from the defective nozzle detector 21. Therefore, it is not necessary to record the test pattern on the recording medium 30, and it is possible to appropriately determine whether or not the recording head 15 is in the error state while eliminating a burden on the user, such as an operation of evaluating the test pattern.

Further, according to this embodiment, the control unit 11 is configured to identify the plurality of nozzles 17 belonging to the different nozzle rows and positioned to be able to record the common raster line as the plurality of nozzles 17 having the specific positional relationship.

According to this configuration, when less than the predetermined number of the nozzles 17 are the defective nozzles, among the plurality of nozzles 17 for ejecting the same color ink that belong to the different nozzle rows and are positioned to be able to record the common raster line, the control unit 11 does not determine that the recording head 15 is in the error state.

Further, according to this embodiment, the recording head 15 includes the first nozzle row and the second nozzle row that are the nozzle rows between which positions of the nozzles are arranged to be offset from each other in the nozzle row direction, which is the direction in which the nozzles are arranged side by side. Then, the control unit 11 identifies the first nozzle and the second nozzle that are adjacent to each other in the nozzle row direction as the plurality of nozzles 17 having the specific positional relationship, the first nozzle being the nozzle belonging to the first nozzle row and the second nozzle being the nozzle belonging to the second nozzle row. Then, the control unit 11 determines that the recording head 15 is in the error state when both the first nozzle and the second nozzle adjacent to each other in the nozzle row direction are the defective nozzles.

According to this configuration, when one of the two nozzles 17 for ejecting the same color ink that configure the nearby nozzle pair is the defective nozzle, the control unit 11 does not determine that the recording head 15 is in the error state.

Further, this embodiment discloses an error determining method including a detecting step for detecting the defective nozzle having the ejecting defect among the nozzles 17 of the recording head 15 including the plurality of nozzles rows configured by the plurality of nozzles 17 for ejecting the same color ink, and a determining step for determining whether the recording head 15 is in the error state based on the detection result from the detecting step. According to the error determining method, in the determining step, it is determined that the recording head 15 is in the error state when, of the plurality of nozzles 17 having the specific positional relationship in which the mutual ejection compensation is possible, the number of the nozzles 17 equal to or greater than the predetermined number, which is greater than one, are the defective nozzles.

6. Other Embodiments

This embodiment further includes various aspects described below.

In the above description of Example 1, at step S130, the control unit 11 extracts the nearby nozzle pairs only from the pairs of the adjacent first nozzle rows and second nozzle rows. However, the control unit 11 may extract the nearby nozzle pairs from pairs of the first nozzle row and the second nozzle row that are not adjacent to each other, such as a pair of the nozzle row 18*w*1 and the nozzle row 18*w*4, for example.

The recording device 10 may include the recording head 15 (a first recording head) including the plurality of nozzle rows 18*w*1, 18*w*2, 18*w*3, 18*w*4, 18*w*5, 18*w*6, 18*w*7, and 18*w*8 illustrated in FIG. 2, and the recording head 15 (a second recording head) including the plurality of nozzle rows 18*c*1, 18*m*1, 18*y*1, 18*k*1, 18*c*2, 18*m*2, 18*y*2, and 18*k*2 illustrated in FIG. 4. In other words, the first recording head and the second recording head are mounted on the carriage 20. For example, in the carriage 20, the first recording head is arranged upstream in the second direction D2 with respect to the second recording head. Then, the control unit 11 performs the error determining processing of Example 1 and the error determining processing in Example 2, and determines that the recording heads are normal when the recording heads can be determined to be normal in both of the error determining processing.

The recording head 15 may be a line head that is long in the first direction D1. In other words, the recording head 15 is fixed to the recording device 10 at an orientation rotated by 90 degrees from a state illustrated in FIG. 2 and FIG. 4. When the recording head 15 is the line head, the carriage 20 is not required. In the line head, each of the nozzle rows is configured by the plurality of nozzles 17 having a constant nozzle pitch along the first direction D1. Further, each of the nozzle rows is configured by arranging the plurality of nozzles 17 over a range corresponding to a width, in the first direction D1, of the recording medium 30 transported in the second direction D2. In the configuration in which the recording head 15 is the line head, the "same position" at step 110 refers to the same position in the first direction D1, and the raster line refers to a line parallel to the second direction D2.

In the recording head 15, some of the nozzles 17 at both ends of the nozzle rows may be preset to be unused nozzles that are not used for the recording. With respect to the unused nozzles, even when the unused nozzle is the defective nozzle, the control unit 11 does not treat the unused nozzle as the defective nozzle in the error determining processing. In other words, among the nozzles 17 included in the recording head 15, the control unit 11 treats the nozzle 17 that is not the unused nozzle and that corresponds to the defective nozzle, as the defective nozzle in the error determining processing.

What is claimed is:

1. A recording device comprising:

a recording head including a plurality of nozzle rows that are configured to eject a same color ink, the plurality of nozzle rows each including a plurality of nozzles that are configured to eject the same color ink;

a detector configured to detect, from among the plurality of nozzles, a defective nozzle having an ejecting defect; and a control unit configured to determine whether the recording head is in an error state, based on a detection result from the detector, wherein the control unit determines whether, among a plurality of the nozzles that have a specific positional relationship in which the nozzles are configured to compensate for each other's ejection, at least a predetermined number of nozzles, which is greater than one, are the defective nozzles, and the control unit determines that the recording head is in the error state in response to determining that at least the predetermined number of nozzles are the defective nozzles.

2. The recording device according to claim 1, wherein the control unit is configured to identify a plurality of the nozzles, which belong to the nozzle rows that differ from each other and positioned to be configured to record a common raster line, as the plurality of nozzles having the specific positional relationship.

3. A recording device comprising:

a recording head including a plurality of nozzle rows of a plurality of nozzles for ejecting a same color ink;

a detector configured to detect, from among the plurality of nozzles, a defective nozzle having an ejecting defect; and a control unit configured to determine whether the recording head is in an error state, based on a detection result from the detector, wherein the control unit determines that the recording head is in the error state when, among a plurality of the nozzles that have a specific positional relationship in which the nozzles are configured to compensate for each other's ejection, at least a predetermined number of nozzles, which is greater than one, are the defective nozzles, wherein the recording head includes the nozzle rows which are a first nozzle row and a second nozzle row, the nozzles of the first nozzle row and the nozzles of the second nozzle row being arranged to be shifted from each other in a nozzle row direction, which is a direction in which the nozzles are aligned, and the control unit identifies a first nozzle and a second nozzle, that are adjacent to each other in the nozzle row direction, as the plurality of nozzles having the specific positional relationship, the first nozzle being a nozzle belonging to the first nozzle row and the second nozzle being a nozzle belonging to the second nozzle row, and determines that the recording head is in the error state when both the first nozzle and the second nozzle adjacent to each other in the nozzle row direction are the defective nozzles.

4. A recording head error determining method, comprising:

detecting a defective nozzle having an ejecting defect from among a plurality of nozzles of a recording head, the recording head including a plurality of nozzle rows that are configured to eject a same color ink, the plurality of nozzle rows each including the plurality of nozzles that are configured to eject the same color ink; and determining whether the recording head is in an error state, based on a detection result of the detecting of the defective nozzle, wherein the determining of whether the recording head is in the error state includes determining whether, among a plurality of the nozzles having a specific positional relationship in which the nozzles are configured to compensate for each other's ejection, at least a predetermined number of the nozzles, which is greater than one, are the defective nozzles, and determining that the recording head is in the error state in response to determining that at least the predetermined number of nozzles are the defective nozzles.

* * * * *